US005409791A

United States Patent [19]

Kaukeinen et al.

[11] Patent Number: 5,409,791

[45] Date of Patent: Apr. 25, 1995

[54] IMAGE FORMING METHOD AND APPARATUS

[75] Inventors: Joseph Y. Kaukeinen; Thomas A. Jadwin; Peter S. Alexandrovich; Eric C. Stelter, all of Rochester, N.Y.

[73] Assignee: Eastman Kodak Company, Rochester, N.Y.

[21] Appl. No.: 65,249

[22] Filed: May 20, 1993

[51] Int. Cl.[6] ..... G03G 13/09; G03G 13/22

[52] U.S. Cl. ..... 430/54; 430/122

[58] Field of Search ..... 430/122, 54

[56] References Cited

U.S. PATENT DOCUMENTS

| | | | |
|---|---|---|---|
| 4,473,029 | 9/1984 | Fritz et al. | 118/657 |
| 4,531,832 | 7/1985 | Kroll et al. | 118/657 |
| 4,546,060 | 10/1985 | Miskinis et al. | 430/108 |
| 4,599,285 | 7/1986 | Haneda et al. | 430/54 |
| 4,629,669 | 12/1986 | Shoji et al. | 430/47 |
| 4,657,374 | 4/1987 | Kuramoto et al. . | |
| 4,666,804 | 5/1987 | Haneda et al. | 430/45 |
| 4,764,445 | 8/1988 | Miskinis et al. | 430/108 |
| 4,803,518 | 2/1989 | Haneda et al. | 355/312 |
| 4,947,200 | 8/1990 | Kumasaka et al. | 355/251 |
| 5,001,028 | 3/1991 | Mosehauer et al. | 430/45 |

FOREIGN PATENT DOCUMENTS 56-144452 11/1981 Japan .

OTHER PUBLICATIONS

Patent Abstracts of Japan, vol. 13, No. 157 (p-857) (3505) 17 Apr. 1989 JP-A-63 314 568 (Konica) 22 Dec. 1988.

*Primary Examiner*—Roland Martin
*Attorney, Agent, or Firm*—Leonard W. Treash

[57] ABSTRACT

An electrostatic image on an image member already containing a loose dry first toner image is toned with a second toner, for example, a toner of a second and different color from the first toner image. The toning is accomplished by a developer having a high coercivity permanently magnetized carrier and toner which is moved through a development zone by a rapidly rotating core inside a sleeve on which the developer moves. Pole transitions caused by the rapidly moving core make the high coercivity permanently magnetized carrier move vigorously in a wave motion having alternating crests and troughs. Scavenging of the first toner image is prevented by separating the sleeve from the image member sufficiently that the crests of the developer do not touch the image member during the toning process. An alternating electrical field is applied between the sleeve and the image member to enhance development.

17 Claims, 10 Drawing Sheets

IMAGE FORMING METHOD AND APPARATUS

CROSS REFERENCE TO RELATED APPLICATIONS

This application is related to cofiled U.S. patent application Ser. No. 08/064,621, METHOD AND APPARATUS FOR FORMING TWO TONER IMAGES IN A SINGLE FRAME, Eric C. Steller at al, filed May 20, 1993; U.S. patent application Ser. No. 08/065,248, PRINTHEAD WRITER ASSEMBLY, Frank J. Koetter et al, filed May 20, 1993; U.S. patent application Ser. No. 08/065,246, METHOD OF FORMING TWO TONER IMAGES IN A SINGLE FRAME, Joseph E. Guth et al, filed May 20, 1993; U.S. patent application Ser. No. 08/064,626, METHOD AND APPARATUS FOR DEVELOPING AN ELECTROSTATIC IMAGE USING A TWO COMPONENT DEVELOPER, Eric C. Stelter et al, filed May 20, 1993; and U.S. patent application Ser. No. 08/064,625, METHOD AND APPARATUS FOR FORMING A COMPOSITE DRY TONER IMAGE, Joseph Kaukeinen et al, filed May 20, 1993.

BACKGROUND OF THE INVENTION

This invention relates to the formation of toner images on an image member. Although not limited thereto, the invention is particularly useful in a method and apparatus for forming two or more different color toner images on a single frame of an image member.

U.S. Pat. No. 4,546,060, Miskinis et al issued Oct. 8, 1985, discloses a method of developing electrostatic images using a developer including a "hard" magnetic carrier having a coercivity of at least 300 gauss when magnetically saturated and exhibiting an induced magnetic moment of at least 20 EMU/gm of carrier when in an applied field of 1000 gauss. A preferred embodiment of this carrier having a much higher coercivity in the neighborhood of 2000 gauss is commercially used to provide the highest quality electrostatic image development presently available. In this method, developer made up of such hard magnetic carrier particles and oppositely charged toner particles is moved at the speed and direction of the image by high s speed rotation of a magnetic core within a shell or sleeve on which the developer moves. Rapid pole transitions on the sleeve cause the high coercivity carrier to experience a torque. "Strings" or "chains" of the carrier rapidly flip on the sleeve to move the developer on the shell in a direction opposite to that of the rotating core. In contrast, a low coercivity, "soft" magnetic carrier will internally magnetically reorient in response to the pole transitions and not experience a torque adequate to cause the carrier to flip.

U.S. Pat. No. 5,001,028 to Mosehauer et al is representative of a number of references describing a process in which a photoconductive image member is uniformly charged and imagewise exposed to create an electrostatic image. Dry toner is applied to the electrostatic image to create a toner image. Usually in this process, discharged area development is used. Thus, the toner applied is of the same polarity as the electrostatic image. Deposits in the areas of lowest charge (the discharged areas) form a toner image having a density which is greatest in the portions of the image receiving the greatest exposure.

Without fixing the first toner image, the image member is usually uniformly charged, again with a charge of the same polarity as the original image and imagewise exposed to form a second electrostatic image generally in the portions of the image member not covered by the first toner image. The second electrostatic image is toned, again with a toner of the same polarity as the electrostatic image but of a color different from the first toner image, to create a second toner image. The process can be repeated with a third electrostatic image toned by a third color toner to create a three color image, etc. The two (or more) color images all have the same polarity and are easily transferred in a single step to a receiving sheet and fused, also in a single step.

Although the process is not necessarily limited to such applications, it is most commonly used to provide accent color prints or copies with laser or LED printhead electronic exposure. All commercial applications known to us use electronic exposure and discharged area development.

The process has a number of advantages in multiple color applications. It eliminates the troublesome, inaccurate and/or expensive steps used in registering images at a transfer station. If it uses separate exposure stations for each image, it can produce multiple color output at the same speed as single color output.

It is important that the second and subsequent toning steps not disturb the first toner image. Otherwise, toner from the first toner image gets mixed into the second development station ("scavenging") and toner from the second development station is deposited on the first toner image ("overtoning"). The relative seriousness of scavenging and overtoning is dependent upon the order of colors. In a system in which a lighter color is deposited first and a darker color later, overtoning is more serious than scavenging. However, in a system in which a darker color, for example, black, is deposited first and the lighter color is deposited second, scavenging of the dark color into the light color toning station is a much more serious problem. Note that overtoning often occurs as a result of scavenging with the second color replacing the scavenged first color toner.

Much of the art prior to Mosehauer recommends use of projection toning for the second and subsequent toning steps in order not to disturb the first image. Unfortunately, it is difficult to obtain reasonable density in high speed imaging with projection toning. The Mosehauer patent suggests that excellent results are obtained using the Miskinis method to develop the second and subsequent images. In its preferred embodiment, the nap of the brush is actually brought into contact with the image. This provides extremely high density images at high process speed. It provides far less scavenging than other high density, high speed systems because of an inherent softness in this type of brush. That is, it does not physically or mechanically rub off the first toner image. However, with this system some scavenging does occur. It remains much preferable to prior projection toning approaches in applications which require high density and high process speed.

Japanese Kokai 56-144452, published Nov. 10, 1981, shows a number of projection toning systems for toning electrostatic images in the presence of unfixed first toner images including rotating core magnetic brushes with two component developer.

U.S. Pat. No. 4,629,669 (Shoji et al) is one of a number of references showing the use of an alternating current field in order to effect projection toning of a series of electrostatic images. Some of the examples in this reference suggest the use of two component developers with a rotating magnetic core inside a rotating sleeve. This reference suggests many solutions to scavenging, including 1) increasing the magnetic field with later images; 2) increasing the amount of developer exposed to the image with later images; 3) increasing the toner concentration with later images; 4) increasing the original charge on the photoconductor with later images; 5) increasing the charge on the toners in later images; and 6) varying the AC component of the bias by reducing a high harmonic wave component for later images. All examples employ toner particles 10 microns in size or greater, although the reference indicates smaller toners would give better resolution. In general, the AC component of the bias is varied between 800 Hertz and 3 kHz with less good results at 800 Hertz. In the moving core examples, the sleeve is moved at or faster than the image, for example, 120–300 mm/sec, while the core is oppositely rotated at from 450 to 750 rpm. Best results were achieved with the developer moving two to three times as fast as the image. The carrier is quite insulating, preferably at $10^{14}$ ohm-cm.

U.S. Pat. No. 4,797,334, Hiratsuka issued Jan. 10, 1989, shows a rotating core and sleeve system in which a single electrostatic image is toned across a gap using a fast sleeve speed and an AC bias that is preferably between 300 Hertz and 2 kHz. The carrier is, again, quite insulating, preferably $10^{14}$ ohm-cm. U.S. Pat. No. 4,657,374, Kuramoto et al, has a similar disclosure for toning a single image. The core is rotated at between 1000 and 2000 rpm with a rapidly rotating sleeve (100–150 rpm).

U.S. Pat. No. 4,803,518 to Haneda et al granted Feb. 7, 1989 also shows development of an electrostatic image in the presence of an unfixed dry first toner image using a rotating core magnetic brush and a two component developer. The carrier typically has a resistivity of $10^{14}$ ohm centimeters and is 30 microns in size. Reduction of color mixing is accomplished primarily by adjustment of AC frequency, voltage and the development gap. The reference suggests that less scavenging will result if the toner has a high charge-to-mass ratio. It increases the toner charge-to-mass ratio with the later images, while reducing the amplitude and increasing the frequency of the AC component of the bias. It prefers projection toning at all stations, but notes that the first station can use contact toning. The toner has an average particle size of 10 microns. See also U.S. Pat. Nos. 4,666,804, Haneda et al issued May 19, 1987; 4,677,929, Haneda et al issued Jul. 14, 1987; 4,822,711, Itaya et al issued Apr. 18, 1989; 4,599,285, Haneda et al issued Jul. 8, 1986.

Those of the above references that suggest the second toning step in a multicolor system be carried out by projection toning with a rotating core brush and an AC component to the bias, generally call for moving the sleeve as fast or faster than the image to increase the amount of developer passing it. They appear to use high charge-to-mass toners to reduce scavenging. They use very insulating carriers. None of these references suggest the use of a high coercivity carrier.

Despite the disclosures in the above applications, the tradeoff between high density development and scavenging still exists in the above prior art. That is, in systems in which the developer nap is separated from the image member in order to reduce scavenging, the density of development makes the system less acceptable at high speed.

SUMMARY OF THE INVENTION

It is an object of the invention to provide a method and apparatus for toning an electrostatic image in the presence of an unfixed dry first toner image while improving the above tradeoff between scavenging and high density development.

These and other objects are accomplished by a method and apparatus for developing an electrostatic image on an image member that has an unfixed dry toner image in the same frame as the electrostatic image. The method includes the steps of supplying a two component developer made up of high coercivity, permanently magnetized carrier particles and toner particles to an applicator having a rotatable magnetic core having alternating poles around its periphery and a shell or sleeve around the core, rotating the core within the shell to create a rapidly changing magnetic field on the surface of the shell to move the developer in a wave motion having alternating crests and troughs through close proximity with the image member but without the crests of the developer contacting the image member, and applying an alternating field between the shell and the image member to develop the electrostatic image.

According to a preferred embodiment of the invention, the core is rotated at greater than 300 rpm, preferably greater than 1000 rpm, with best results greater than 1500 rpm. It includes at least eight alternating poles around its perimeter and has preferably more than 10 poles, for example, 12 poles. The carrier has a coercivity of at least 300 gauss when magnetically saturated, and preferably in excess of 1500 gauss, for example, 2000 gauss. It preferably exhibits an induced magnetic moment of 20 EMU/gm or more of carrier when in an applied field of 1000 gauss.

The characteristics of the carrier and the rotating core are similar to that used in the Mosehauer prior art. However, we were aware that such prior art moved the developer rapidly in a wave formation having substantial amplitude around the shell with the wave formation having rapidly changing crests and troughs (see FIG. 7). We thought that the crests and troughs would make the maintenance of a gap more difficult or impossible. However, Applicants have found that when this system is used, even at relatively small gaps between the crests of the developer and the image member, these gaps are maintainable despite the vigorousness of developer movement. Further, because of this vigorousness, sufficient completion of development is obtained for high speed image formation with negligible scavenging. Because of this vigorousness, relatively low charge-to-mass toners can be used which have a positive effect on the density of the image.

According to a further preferred embodiment, we found that, contrary to the projection toning teachings of the prior art, better line width in imaging was obtained with a substantially more conductive carrier. That is, using a high coercivity carrier having a resistivity less than $10^{13}$ ohm-cm, preferably less than $10^{9}$ ohm-cm reduced a phenomenon of thin lines in high speed projection toning. Although many of our examples show very good results with carriers having a resistivity of $10^{11}$ ohm-cm, best results in this respect were obtained with a carrier having a resistivity less than $10^{6}$ ohm-Cm, for example, $10^{4}$ ohm-cm.

From the above, it can be seen that it is also an object of the invention to provide an improved projection toning method and apparatus, regardless of its application.

BRIEF DESCRIPTION OF THE DRAWINGS

In the detailed description of the preferred embodiments of the invention presented below, reference is made to the accompanying drawings, in which.

DESCRIPTION OF PREFERRED EMBODIMENTS

This invention deals with two component developing. Consistent with the terminology in the art, the term "developer" includes both "carrier" and "toner" which make up the two component system. The carrier is of a magnetizable material and is intended to stay with the toning apparatus. The toner is charged by the carrier to a charge opposite the carrier and is deposited on the electrostatic image and regularly replenished in the developer.

Figure 1:
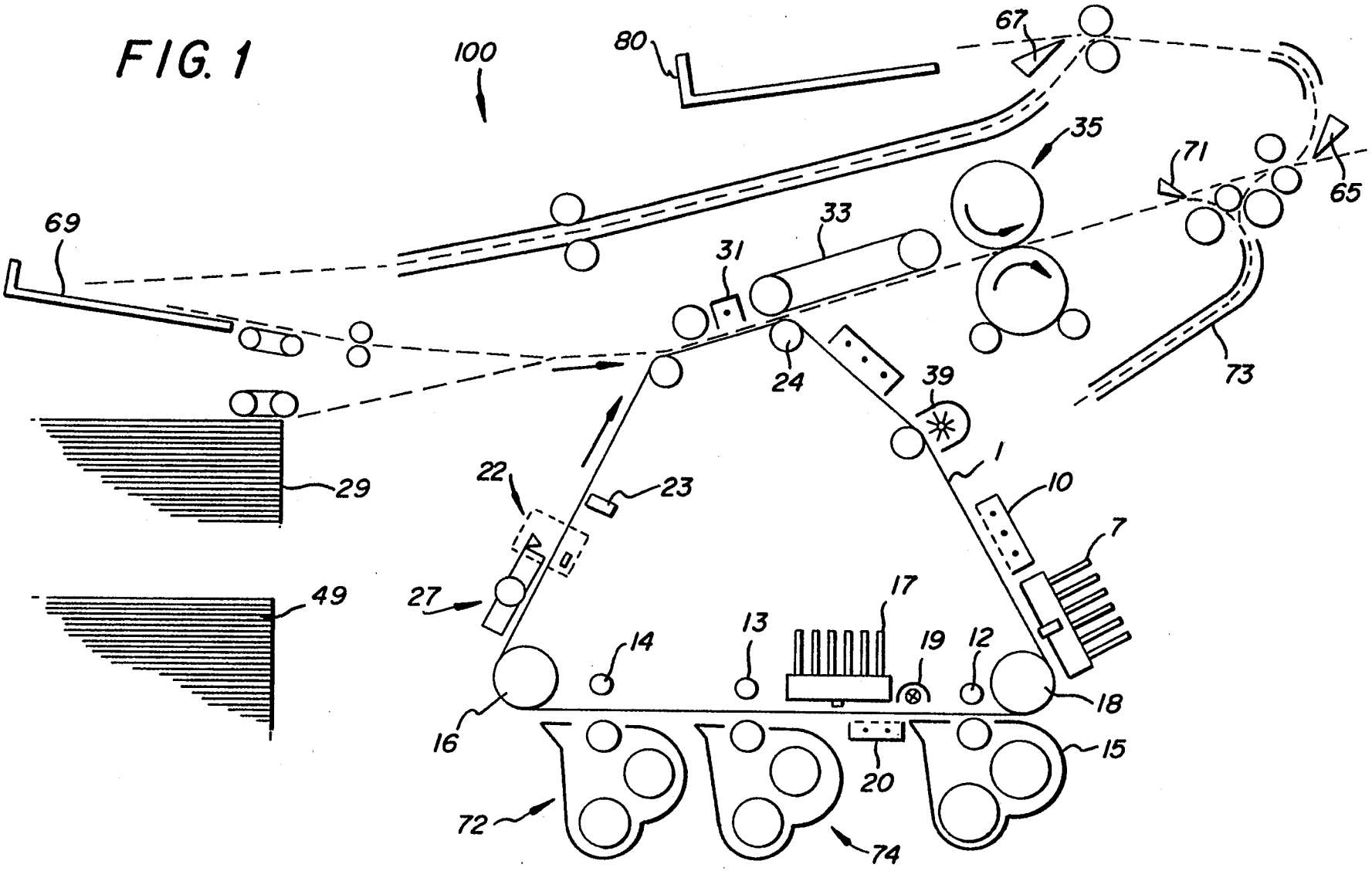
FIG. 1 is a side schematic of an image forming apparatus.

According to FIG. 1, an image forming apparatus 100 includes an endless belt photoconductive image member 1 which is trained about a series of rollers to move through an endless path. In operation, image member 1 is first uniformly charged by a charging station 10. The charged image member 1 is imagewise exposed by an LED printhead 7 or a laser or other suitable exposing device, including an optical exposing device, to create a first electrostatic image. The first electrostatic image passes around a roller 18 and is toned by a first toning station 15 which preferably contains the darkest color in the machine, for example, black, to create a first toner image. Preferably, discharged area development is used to create a toner image in the areas exposed by printhead 7.

The same frame or area of the image member 1 is again uniformly charged, this time, by a second charging station 20, preferably of the same polarity as applied by station 10, and imagewise exposed by a second LED printhead 17 which exposes through the rear of the image member 1 to create a second electrostatic image. Although there are advantages to exposing through the base, front exposure could also be used. Prior to the second charging step by station 20, the image member 1 is blanket exposed through its base by a rear erase lamp 19 to eliminate any charge under the toner image. Although station 20 applies a similar polarity charge, this erasing step appears to increase the hold between the first toner image and the image member. The discharged areas of the second electrostatic image are toned by toner from one of toning stations 72 or 74 to create a second toner image which normally would be of a lighter color than the first toner image. For example, if the first toner image is black, the second toner image can be almost any other color. The image member 1 now carrying a two color, unfixed, dry toner image, passes around a roller 16 and adjacent a carrier scavenger 27 which attracts any magnetic carrier deposited in the toning processes and adjacent a densitometer 22 which is used to control the process. It may also be exposed to an erase lamp and an alternating current corona (not shown) at this point to loosen the toner image on the image member as is well known in the art. Scavenger 27 may attentively be located between toning station 15 and toning station 74.

A receiving sheet is fed from one of two receiving sheet supplies 29 or 49 into a transfer station 31 where the two color image is transferred in a single step to the bottom side of the receiving sheet by conventional electrostatic transfer, well known in the art. Corona transfer, roller backed transfer, or any other type of transfer, including heat assisted transfer may be used. The receiving sheet is transported by suitable vacuum transport 33 to a fuser 35 where the two color image is fused in a single step. The receiving sheet can then go to any of three paths. It can continue on a straight path to a finisher (not shown), or it can be deflected into an upper path by a suitable deflector 65. Once in the upper path the receiving sheet can go directly into an upper output hopper 80 or be deflected by another deflector 67 into a duplex path which carries it to a duplex tray 69 where it can be refed to receive further images from transfer station 31. If the new images are to be placed on a side opposite that of the first images, the receiving sheet is deflected and is moved into the duplex tray directly as just described. However, if a third color image is to be added to the same side of the receiving sheet as the combined two color image, then the receiving sheet must be inverted. This is accomplished by use of a deflector 71 which deflects the receiving sheet into a J turnaround 73 which turns the sheet around and sends it on its path as deflected by deflectors 65 and 67 into the duplex tray 69.

In this way three color images can be superimposed on a receiving sheet utilizing two frames. The first two images are placed on the first frame and the third image on the second frame. This apparatus is designed to provide two color images at full machine speed with a choice of two different colors for the second image. The addition of the third color reduces the productivity of the process to provide the extra image. Since registration is easier to maintain between the first two images in the portion of the process using the single frame, the third color should be the color requiring the least exact registration.

As shown and described with respect to FIG. 1, each of the toning stations is capable of being turned "off" for a specific electrostatic image. This is accomplished in the FIG. 1 embodiment, in a manner known in the art, by moving a backup roller 12, 13 or 14 toward its station to position image member 1 in operative relation to that station. In apparatus (not shown) in which each color is always used, this flexibility is unnecessary and each station could always be "on".

Figure 3:
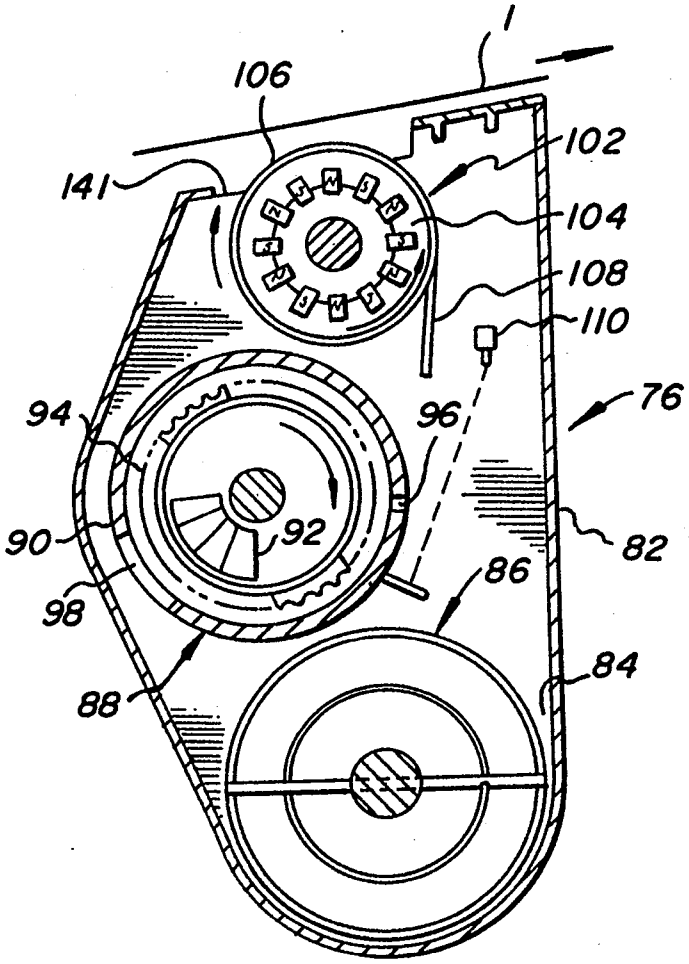
FIGS. 2 and 3 are side sections of a toning apparatus.
Figure 2:
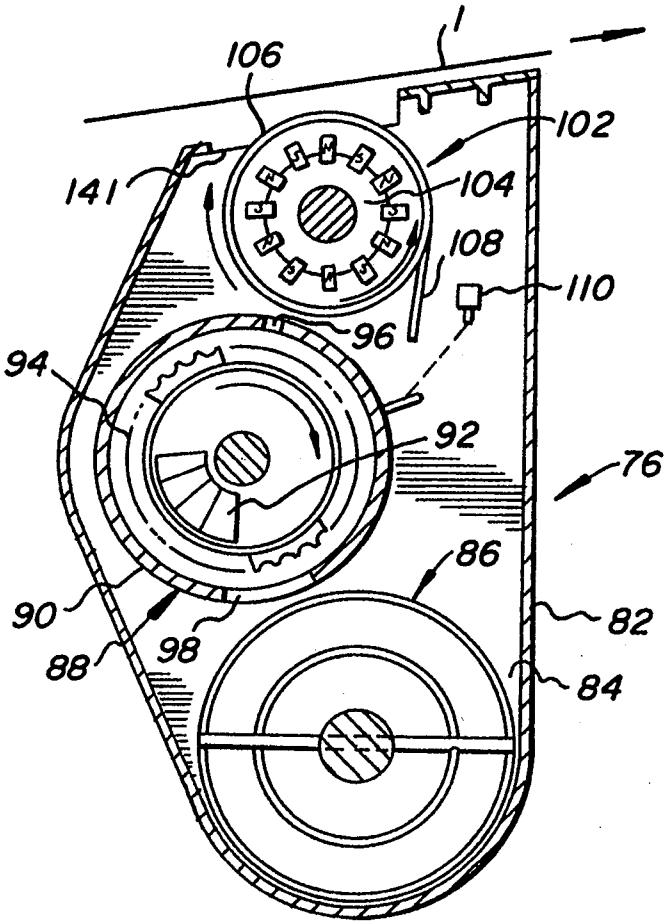

FIGS. 2 and 3 illustrate a presently commercially used toning station 76 adaptable to the application shown in FIG. 1 for stations 15, 72 and 74, although somewhat different in design from the stations shown in FIG. 1. Movable backup rollers 12, 13 and 14 are not necessary since naming of station 76 on and off is accomplished differently, as described below.

Referring to FIGS. 2 and 3, toning station 76 includes a housing 82 which defines a sump 84 in which is located a ribbon blender 86. Ribbon blender 86 mixes two component developer in the sump.

A developer flow valve 88 is positioned between the sump 84 and an applicator 102. The developer flow valve 88 includes a sleeve 90 spaced from a fluted developer transport roller 94. A magnet 92 is strategically located inside of fluted roller 94. Sleeve 90 has an entrance 98 and an exit 96. The position of sleeve 90 is controlled by a solenoid 110.

In a toning operation, as shown in FIG. 2, developer is attracted by magnet 92 through entrance 98 into a space between sleeve 90 and fluted roller 94. Fluted roller 94 with the aid of magnet 92 drives developer clockwise up the left side of sleeve 90 to exit 96 where the developer is attracted into contact with a sleeve 106 forming part of applicator 102. Developer flow can be shut off, as shown in FIG. 3, by actuation of solenoid 110 which rotates sleeve 90 clockwise to move both the entrance and exit away from the respective operative positions shown in FIG. 2, thereby preventing flow of developer to applicator 102. This allows the station to be turned "on" or "off" according to whether or not an electrostatic image is to be toned in the color toner in that station.

Figure 4:
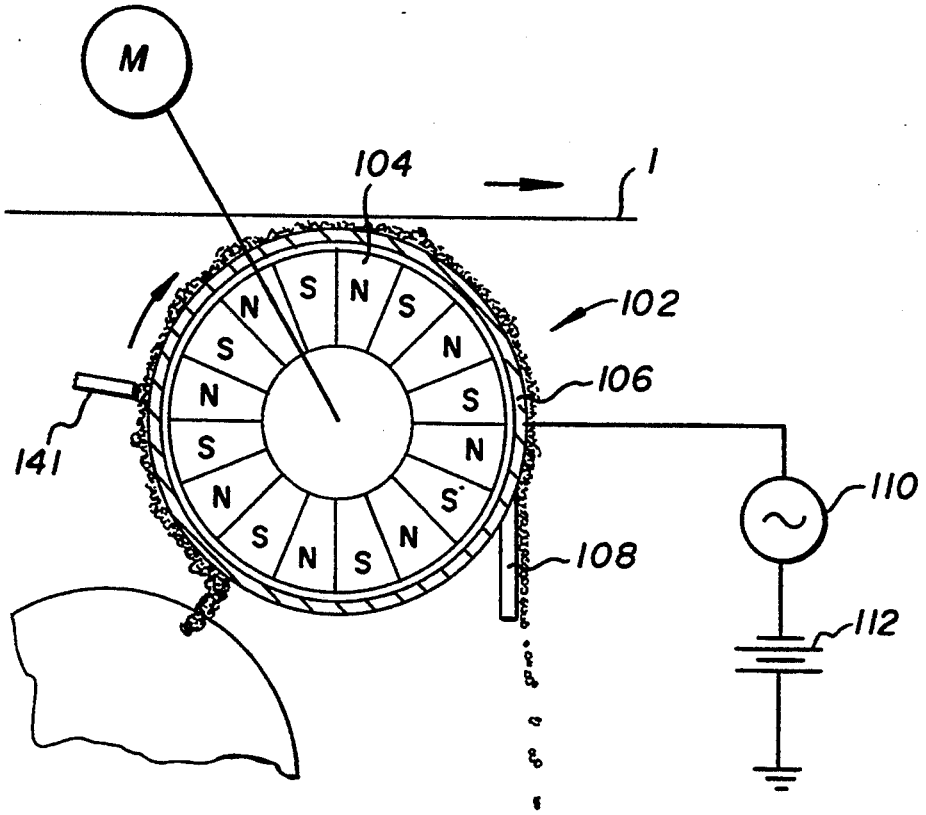
FIG. 4 is a side schematic section illustrating the operation of a portion of a toning apparatus.

Applicator 102 includes sleeve or shell 106 which surrounds a rotatable magnetic core 104. Magnetic core 104 has alternating poles around its circumference. For example, as shown in FIGS. 2 and 3, core 104 has twelve poles while, as shown in FIG. 4, core 104 has sixteen poles. Core 104 is rotated by a motor M (FIG. 4) at a high rate of speed, for example, 2000 rpm. The rapid rotation of core 104 causes developer on sleeve 106 which includes a high coercivity permanently magnetized carrier to experience rapid pole transitions. Because the carrier is of high coercivity and is permanently magnetized, the carrier "flips" or rotates in a direction opposite to that of the rotation of the core. The rotation of the carrier causes it to move around the sleeve 106 in a direction opposite to the rotation of the core.

Development stations 15, 72, 74 and 76 operate on this basic principle with the developer moving through a development zone closely adjacent to the image member and moving in the same direction as the image member, and preferably, at the same speed as the image member. Movement in the same direction and speed as the image member can be controlled not only by design and speed of magnetic core 104 but by movement of the sleeve. The movement of the sleeve can be in either direction to combine with the core speed to is provide a net speed of the developer. Movement of the sleeve in a clockwise direction adds to the flow, while movement in a counterclockwise direction detracts from the flow. The sleeve also can be stationary. Actual movement of the developer is primarily by the rotating core. This approach to moving developer through a development zone is explained in the previously mentioned Mosehauer et al and Miskinis et al patents as well as in other previous patents; see, for example, U.S. Pat. Nos. 4,473,029, Fritz et al; and 4, 531,832, Kroll et al. These four patents are incorporated by reference herein.

Figure 6:
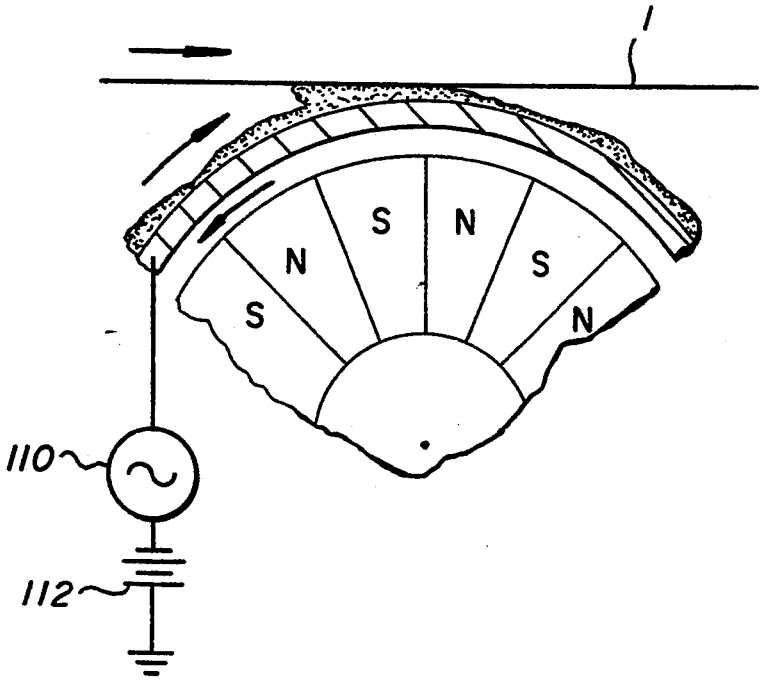

According to the Mosehauer patent an electrostatic image on an image member frame already containing a dry toner image can be toned by contacting the image (as shown in FIG. 6) with the nap of a brush of the type illustrated in FIGS. 2, 3 and 4. Although with most materials, some scavenging of the first toner image does occur, the o effect is relatively small and the process is capable of extremely fast and highly efficient toning of the second electrostatic image. It thus is capable of providing two, or more, color images at very rapid machine speeds, for example, 100 letter-sized images per minute.

If scavenging cannot be totally eliminated, it becomes desirable to form the light (color) image first and the dark (black) image second to prevent contaminating the lighter developer with the darker toner. This order of image production, however, becomes unacceptable if overtoning is not totally eliminated. Any scavenging has a tendency to cause overtoning with the second toner replacing the first. Further, overtoning is difficult to eliminate without evening up the charge on the image member after creation of the first toner image, for example, using charging station 20 in FIG. 1. Unfortunately, this charge evening step has a tendency to loosen the toner in the first toner image and promote both scavenging and lateral spreading of the first image.

A preferred tradeoff between these problems is to create the dark image first and then use projection toning for the second image. Unfortunately, prior art projection toning mechanisms, as described at the beginning of this specification, have generally been less efficient and, therefore, require a slower speed to have masonably dense and efficient development.

Figure 7:
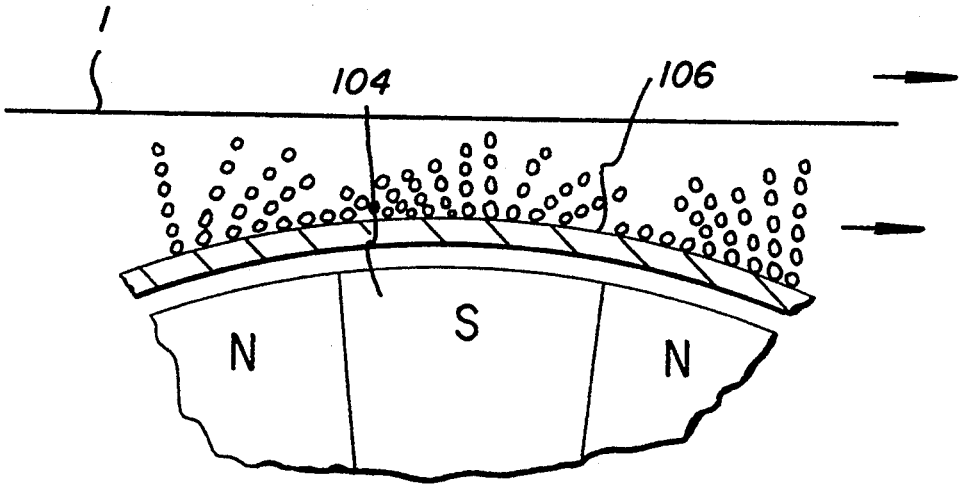
FIG. 7 is a side view, not to scale, illustrating developer carrier movement as it forms crests and troughs on a developer sleeve.

Applicants originally believed that projection toning with the Mosehauer apparatus would be difficult. The mason for this belief is illustrated best in FIGS. 4–7 where it can be seen that the rapid pole transitions caused by the rapid rotation of core 104 causes the developer to move in a wavelike formation having alternating crests and troughs. As illustrated in FIG. 7, the crests and troughs are formed by strings of developer that alternately stand up and lay down while they flip or rotate around the shell 106. This wavelike movement is due to the action of high coercivity, permanently magnetized carrier particles in the rapidly changing magnetic field created by the very rapidly rotating core.

More specifically, referring to FIG. 7, chains of carrier particles form a crest, or stand-up nap, directly above either a north or south pole of the magnetic core. The trough or lay-down nap exists between poles. Chains in the stand-up nap are observed to actually flip o toward the next approaching (opposite polarity) magnetic pole of the rotating core. This is why the developer is transported in a direction opposite to the motion of the poles of the core. Prior art carrier particles without an adequate degree of permanent magnetization (too low a coercivity) can internally magnetically orient in response to the alternating magnetic field of the core and, thus, not be subjected to the rather violent, but desirable, flipping action seen with higher coercivity carrier particles.

Surprisingly, it was found that the developer crests could be slightly spaced from the image member and effective development carded out without irregularity in the crest height causing scavenging. FIGS. 2, 3 and 4 show an input side skive 141 that limits the amount of developer allowed into the development zone. It also affects the height of the crests as they approach the development zone. These crests tend to reform at natural height for the parameters of the system and may be higher than the separation allowed by skive 141. Regardless of the effect of skive 141, we have found the crest height in the development zone to be very controllable.

Further, although development completion is reduced by the image member to crest gap, the vigorousness of the high coercivity, permanently magnetized carrier in the rapidly changing field provides sufficient density of development to be effective at speeds of 90 letter-size images a minute and more.

Figure 5:
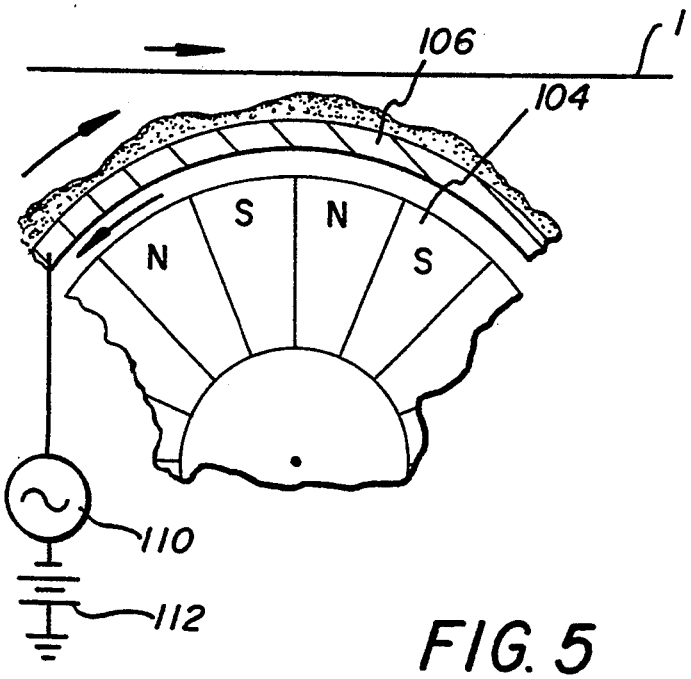
FIGS. 5 and 6 are also schematic side sections similar to FIG. 4 and magnified to illustrate the action of the developer in two different toning applications.

FIG. 5 is similar to FIG. 4 but illustrates better the wave formation of the developer and exaggerates the gap between the developer and the image member. Note that the core 104 is rotated in a counterclockwise direction while the developer, in response to rotation of the core, moves in a clockwise direction in wave formation. The crest of the wave does not touch the image member 1. A source 110 of an alternating electrical field with a DC component from a DC source 112 is applied to the sleeve 106. This creates a field with respect to an electrostatic image carried by image member 1. Image member 1 includes a grounded backing electrode, conventional in the art. Like prior projection toning systems the alternating electrical field is used to improve the deposition of toner. The alternating electrical field includes a direct current component chosen to give good density in the image but to eliminate deposition of toner in the background areas, also as is known in the art. The DC component of the field is used to urge toner generally in a direction toward areas that are to be image areas and away from areas that are to be background areas. In discharged area development, if the image areas have extremely low potential, for example, −50 volts, and the background areas have a high potential of, for example, −500 volts, a typical DC component supplied by DC source 112 would be between −350 and −450 volts.

EXAMPLE 1

Figure 8:
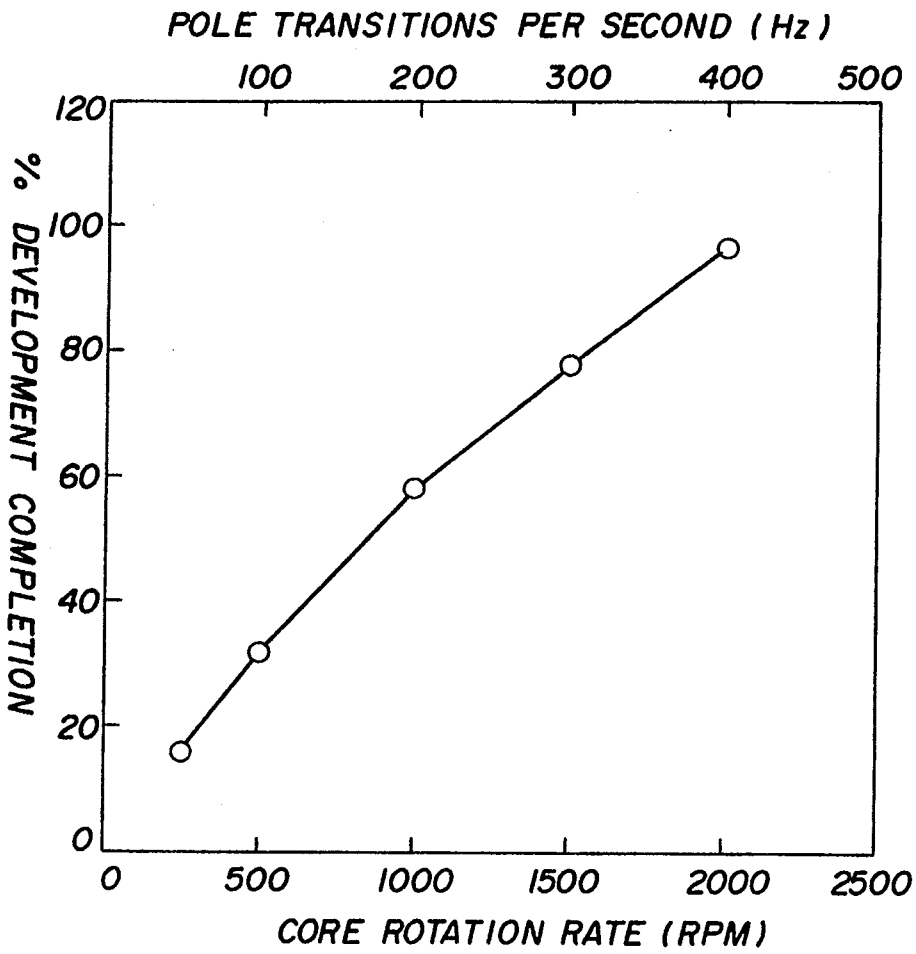
FIG. 8 is a plot of development completion versus core rotation rate.

We have found that by increasing the vigorousness of developer motion by increasing the speed of rotation of the magnetic core and, therefore, the pole transitions, the development rate ability is increased, thus, contributing to high speed imaging. FIG. 8 illustrates this finding. This experiment was carried out on a laboratory breadboard operating at a relatively slow 125 mm per second photoconductor speed (corresponding to 30 ppm copy rate). Developer made up of 12 percent toner and 88 percent carrier by weight, with the toner having a charge-to-mass ratio of 10 microcoulombs per gram, was used at a nap density of 0.00034 g/mm$^2$. The carrier was of coercivity of 2000 gauss, and saturation moment of 55 EMU/gm and was magnetically saturated (permanently magnetized) in a field of 8000 gauss. The magnetic brush was 50 mm in diameter, with 12 magnetic poles, with a field strength of about 850 gauss measured at the shell surface. The photoconductor to shell space was 1.25 mm, with the crests of the developer (affected by an input skive) being about 0.85 mm high leaving a 0.40 mm gap for toner to be projected across. An AC squarewave bias of 3 kV peak-to-peak at 1 kHz was applied on top of the DC bias which was set at 70 V below the charging potential. The toner was of negative polarity and the photoconductor was charged negatively, thus, discharged area development was used (exposed areas are toned).

FIG. 8 is a plot of development efficiency or completion versus core rotation rate in rpms and pole transitions per second. Development completion in discharged area development is defined as the percentage increase in the voltage of an exposed area due to toning based on the total voltage available of that area, or $$\%\ \text{development completion} = \frac{(V_{toned} - V_{exp})100}{V_b - V_{exp}}$$

where $V_b$ is the DC component of the brush bias, $V_{toned}$ is the voltage of the area after toning, and $V_{exp}$ is the voltage of the exposed area before toning. A higher rate of development will result in a higher development efficiency. For image members having organic photoconductors of the type and capacitance used in high speed printers, such as the Kodak Ektaprint 1392 printer, and developers with toner charge-to-mass ratios in the 6–25 $\mu c/g$ range, about 30 percent completion of development is required to achieve adequate density within the available range of exposure and charging voltage. It is seen that 30 percent completion at 125 mm/sec image member speed is achieved with a core rotation of 500 rpm. However, at that image member speed, nearly 100 percent completion is achieved at 2000 rpm. From the data in FIG. 8, it is clear that with a core rotation of 2000 rpm, more than 30 percent completion would be obtained at 400 mm/sec and higher, providing good density at 90–120 images per minute and faster. In examples that follow, the presumption made with respect to the FIG. 8 data is shown to bear out with actual development at high speeds from a non-contacting rotating core brush using developers containing high coercivity, permanently magnetized developer materials.

We believe that the violent chain flipping action is responsible for the generation of a powder cloud of toner available in the gap to be attracted to the electrical field of the latent image aided by the electrical field of the superimposed AC signal. This violent chain flipping action is caused by the effect of the rapid pole transitions on the high coercivity carrier.

Note that the vigorousness of the developer in mechanically creating the powder cloud is directly dependent on the pole transitions per second. As shown in FIG. 8, a twelve pole core at 1000 rpm provides about 200 pole transitions per second while at 2000 rpm, it provides about 400 pole transitions per second. A larger number of poles and greater rotational speed provides a more dense powder cloud. We believe the only limitation to this principle is the expense of the equipment in obtaining higher speed (including heat control) and the ability to increase the number of poles while maintaining their strength.

The crests of the wave formation turn out to be quite stable in height. The process is effective across a masonable range of gap sizes thereby allowing substantial tolerances and providing a robust system. For example, with crests at 0.75 mm in height, we found a spacing of 0.9 mm between the shell and image member provided negligible contact and no noticeable scavenging at 400 pole transitions per second. This is true despite troughs we estimated at a height of approximately half the distance between the crests and the shell and despite great vigorousness of the developer.

For purposes herein, the term "space" or "spacing" refers to the distance between the sleeve or shell 106 and image member 1 at its closest point. The term "gap" is the distance between the crest of the developer and the image member 1 at the closest point.

The actual gap chosen in a particular system we believe should be dependent on the mechanical tolerances of the system. For example, if the spacing between the shell and image member can be held within 0.1 mm, then a gap slightly more than 0.1 mm is preferred. If tolerances, for example, in a low volume apparatus are higher, the gap must be higher to prevent touching of the developer crests and the image member. The height of the developer crests turns out to be easier to control in many systems than is the mechanical spacing.

EXAMPLE 2

In this example a number of runs were made to tone electrostatic images using projection toning with a developer made up of 12 percent toner and 88 percent carrier by weight. Images were made with a 240 dots per inch (10 per mm) LED printhead. All of the tests were run at 92 images per minute. This converts to an image member speed of about 374 mm per second. A series of sample electrostatic images were toned with a toning brush having a 50 mm diameter shell around a 14 pole core. This apparatus provided 233.3 pole transitions per second at 1000 rpm. Images were toned at core speeds from 990 rpm to 1320 rpm (231 to 308 pole transitions per second). The tests were run with an AC potential of 2500 volts peak-to-peak and 1.5 kHz, with a DC component of minus 400 volts. The sleeve was spaced 1.10 mm from the image member and the crests of the developer nap were controlled by a skive at 0.30 mm from the shell, resulting in a crest height of approximately 0.5 mm.

The transmission density of the solid black areas of the images increased linearly from 0.64 to 0.79 while the reflectance density increased from 1.10 to 1.23. This density is not as good as contact density with this kind of brush but is very acceptable for most accent color imaging. It is remarkable for projection toning at this image member speed.

In the same test, pixel width was measured. It also increased linearly from a pixel width of 64 microns to 79 microns as core rotation speed was increased from 990 rpm to 1320 rpm. Although higher is preferred, 65 microns is considered acceptable to provide good text line thickness.

EXAMPLE 3

Figure 9:
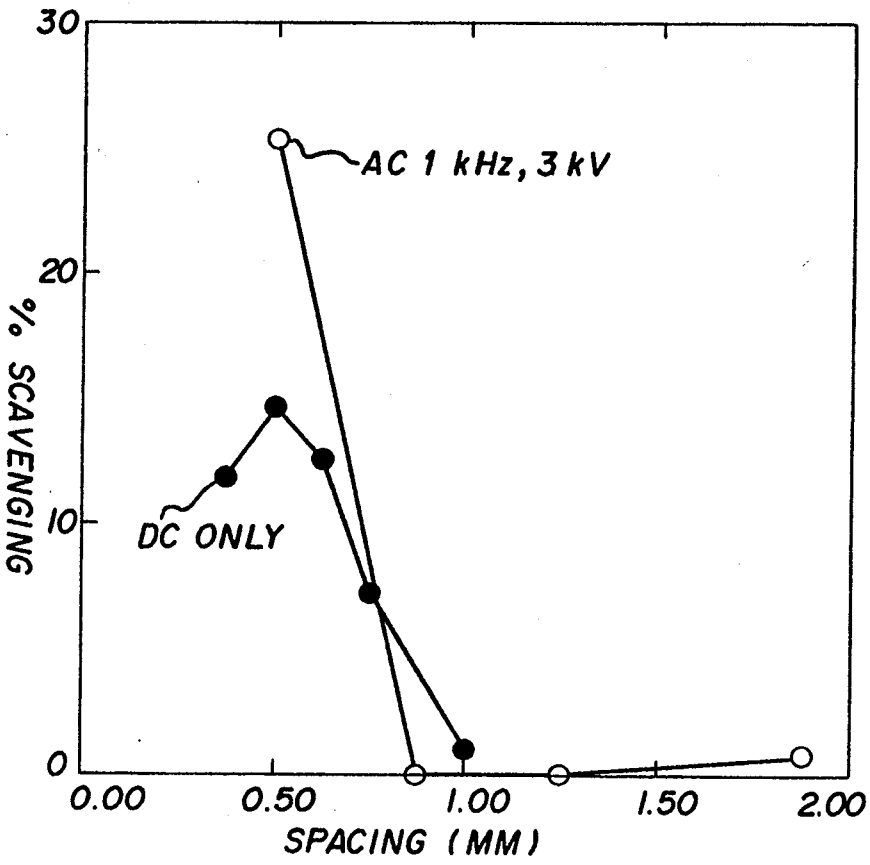
FIG. 9 is a plot of scavenging versus sleeve-to-image member spacing.

This experiment was conducted on the same equipment and with the same materials as Example 1 and with a 70 V DC offset. In this experiment spacing was varied to show the effect on scavenging for both toning with a 1 kHz, 3 kV AC bias and without an AC bias added to the DC offset. The results are shown in FIG. 9 where % scavenging is plotted against spacing in min. More specifically, FIG. 9 illustrates the elimination of scavenging of a first toner deposit by increasing the spacing between the toning sleeve or shell and the image member. Note the virtual total elimination of scavenging with even a very small gap. Values of scavenging in this experiment have a precision of about ±2 percent due to densitometry errors associated with increasingly small differences in density. It is desirable to set the spacing large enough that the crests of the developer do not contact the photoconductor or the toner from the first image. Although acceptable results for many uses are obtained at higher gaps, for best high speed results, the gap should be as close as can be used without mechanical tolerances risking touching. Too large a gap at high speed can exacerbate the known problems of projection toning such as narrow development of lines and overall slow rate of development. A narrow gap is not a problem if them is no risk of touching.

EXAMPLE 4

Figure 11:
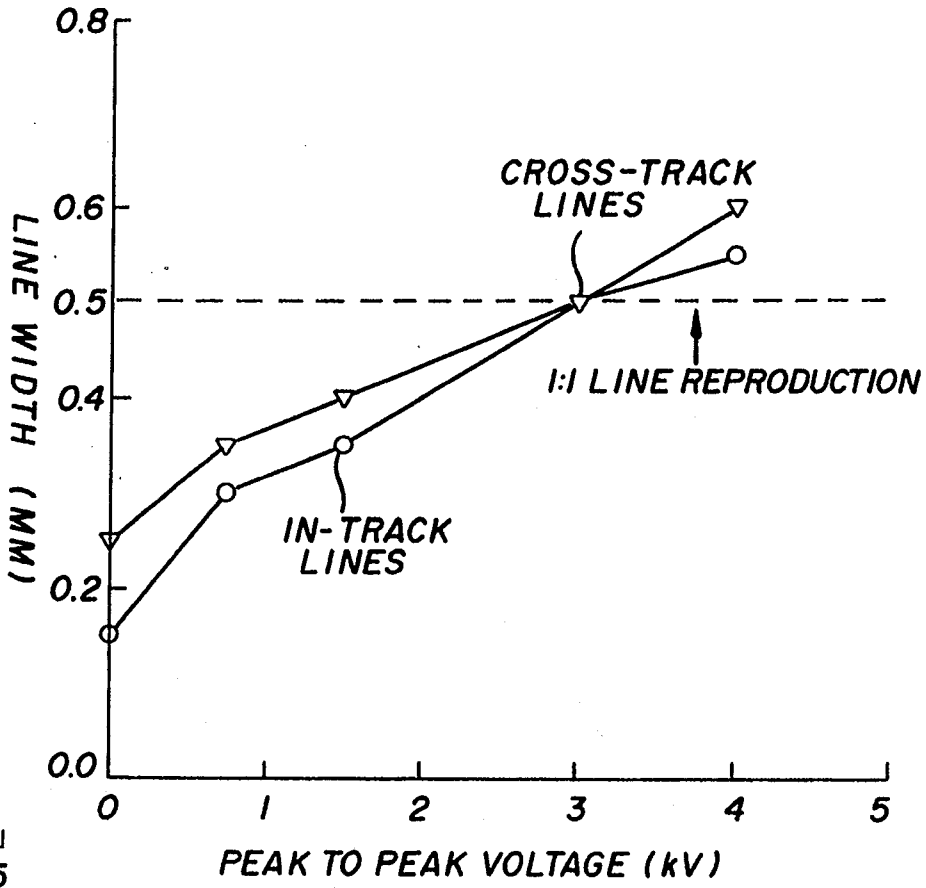
FIGS. 10 and 11 are plots of development completion and line width, respectively, against peak-to-peak voltage.
Figure 10:
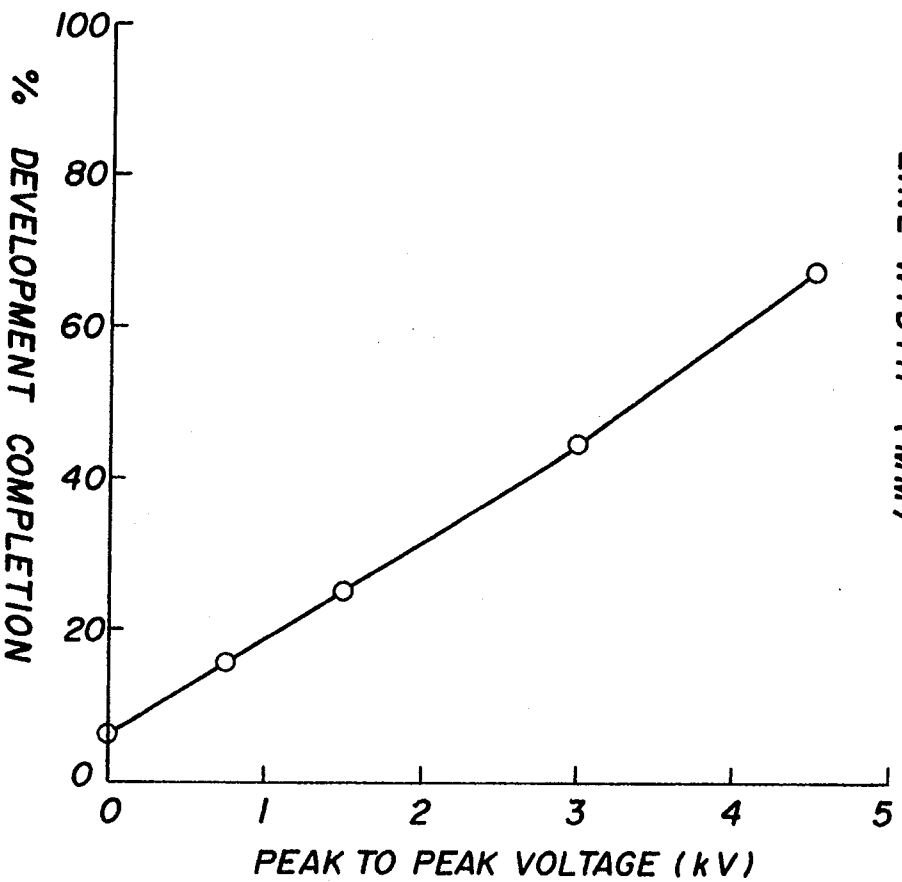

The effect of AC peak-to-peak voltage is shown in FIGS. 10 and 11, which were generated on the equipment and materials of Example 1. The FIGS. 10 and 11 data was obtained using a 1.5 kHz signal with a 1.25 mm spacing and a 70 V DC offset. FIG. 10 plots % development completion against peak-to-peak voltage. The higher the AC amplitude, the faster the rate of development, and the higher is the percent completion of development, and the higher is the copy rate that a machine can operate at. By adjusting the AC voltage, the known problem of narrow line development of projection toning can be reduced. This latter concept is illustrated in FIG. 11. Line width in mm is plotted against peak-to-peak voltage using 0.5 mm target lines. Some background was observed in this experiment at 4500 volts. Thus, with any set of materials and other parameters such as DC offset voltage, there is an upper background limit on the preferred range that must be determined empirically.

EXAMPLE 5

Figure 12:
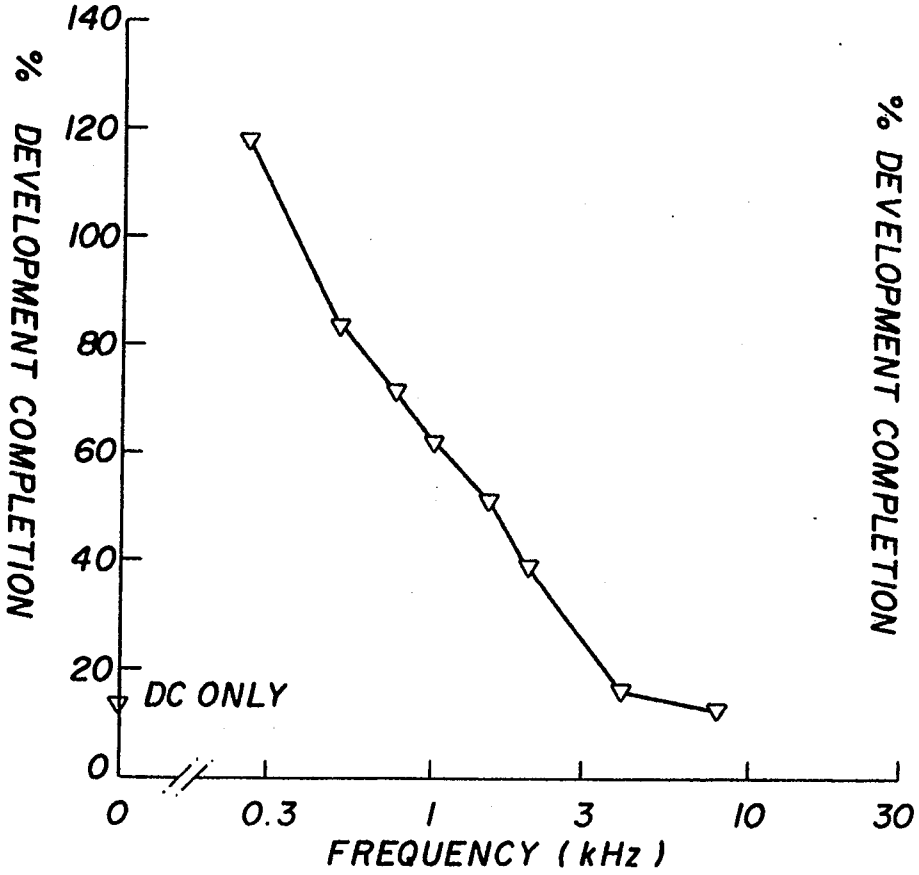
FIG. 12 is a plot of development completion against AC frequency.

Using the same equipment and materials as Example 1, AC frequency was varied with a 3 kV square waveform signal at a spacing of 1.25 mm. Percent development completion is plotted against frequency of the AC signal in FIG. 12. The lower the frequency, the higher is the observed completion of development and, thus, the higher the rate of development. This was, at first, a surprising observation to us. Some prior art suggests using an AC field to knock toner loose from the carrier to create a powder cloud. If this were true in our invention, it might be expected that the higher the frequency, the higher the rate of development. The opposite was, in fact, observed.

We believe that the toner cloud used to effect development is not created by the AC field in the present system, but is instead generated in a mechanical fashion by the rapid chain flipping action of the developer caused by the combination of the rotating magnetic core and the high coercivity carrier particles. We believe that the AC signal serves to transport toner from the cloud generated by the core to the photoconductor, and that the transport occurs during one "projection" half-cycle of the AC waveform, before the following "retraction" half-cycle pulls the particles back toward the brush. In this manner, we understand the frequency dependence of FIG. 12 in that an individual projection half-cycle of the AC waveform is longer in time the lower the frequency and, thus, more toner from the mechanically generated cloud can transit the gap during that time. In this respect, the reaction is much like single component projection toning.

EXAMPLE 6

To test scavenging using projection toning, two tests of 60,000 images each, at 92 letter sized images a minute, were run without adjustment to the test apparatus. A spacing between the shell and the image member was used of approximately 1.50 mm. The height of the crest was approximately 0.75 mm leaving a gap between the crest and the image member of approximately 0.75 mm. In the course of both runs toning was accomplished of the second image with virtually no scavenging. This was as true at the end of the run as at the beginning of the run. It appears that the separation eliminates all noticeable scavenging. For the test a high coercivity permanently magnetized carrier that was strontium ferrite based with a coercivity of about 2000 gauss and a resistivity of about $10^{11}$ ohm-cm was used for both toning stations with insulative toners of different color.

EXAMPLE 7

Figure 13:
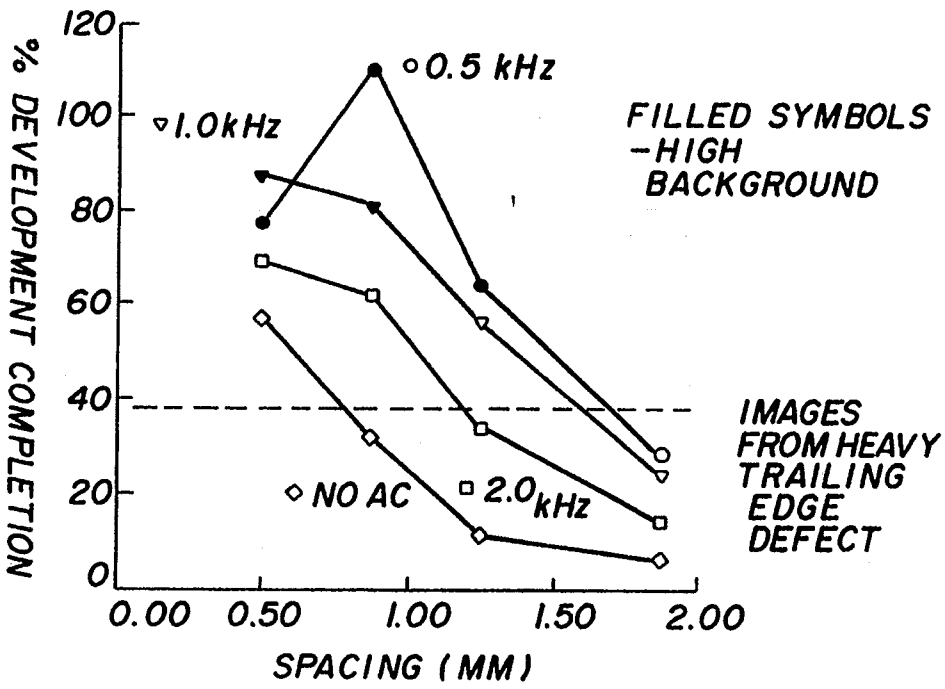
FIG. 13 is a plot of development completion against spacing.

Since a remarkable result of the invention is to be able to effectively tone at substantial speeds, a number of tests were run to find out the effect of various parameters on development completion. A test was run with the same strontium ferrite based carrier with the toner used in Example 6 on the Example 1 equipment to examine the effect of spacing on development completion. FIG. 13 illustrates the results where % development completion is plotted against shell to image member spacing. Using a 3 kilovolt AC square waveform alternating field between the shell and the conductive backing for the image member at various frequencies, the spacing was varied from 0.50 mm, which with a 0.75 mm crest involves no gap or a contact situation to approximately 2.0 mm. Note that development completion in the contact situation was good for all AC frequencies (although with some background development at low frequencies) and that development completion reduced as the gap increased. However, acceptable copies with unnarrowed lines were obtained at spacings as large as 1.25 mm, a gap of 0.50 mm at a frequency of 1 kHz. This graph suggests that development station 15 which does not have either an overtoning or a scavenging problem is preferably of a contact nature for higher development efficiency but that stations 72 or 74 would give good results with a gap of up to 1.0 mm.

EXAMPLE 8

Figure 14:
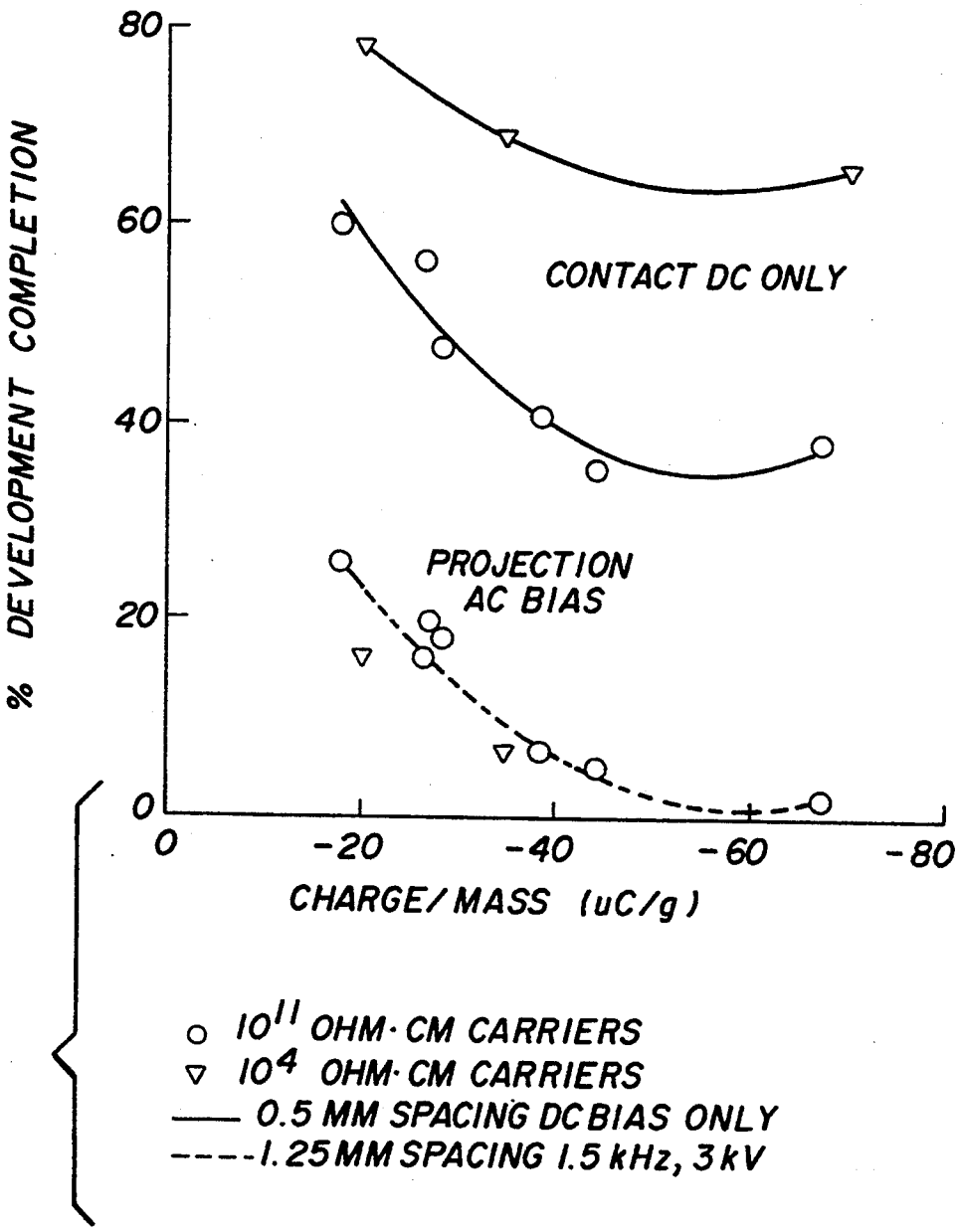
FIGS. 14 and 15 are plots of development completion and line width, respectively, against charge-to-mass ratio.

Using the same equipment as in Example 7, the effect of toner charge was examined. FIG. 14 shows percentage of development completion as a function of charge to mass and illustrates both contact with a DC bias only and projection with an AC bias experiments. Note that the preferred charge to mass for greatest development completion is a low charge to mass of up to −20 microcoulombs per gram with development diminishing as the charge to mass gets higher from that point. Further, note that contact development provides more development completion at a given charge to mass.

FIG. 14 demonstrates that development is more rapid and, thus, completion is higher for toners of lower charge-to-mass than higher charge-to-mass. This is both a remarkable and a desirable result of the present invention. We believe this to be the result of the combination of the rotating magnetic core toning brush, higher coercivity carrier particles and AC bias. If the purpose of the AC field is to strip toner from carrier and, thus, generate a toner cloud for projection across the gap, it would seem that the higher the charge on a toner particle, the higher would be the force exerted by the AC signal, and, thus, the faster the rate of development. In prior art rotating core-two component-projection toning systems, an AC signal applied to a brush is used to create a scavengeless toning step. However, this prior art does not describe the use of high coercivity carrier particles and, in fact, observes behavior opposite to that of the present invention. In general, it is stated that the toner in the prior art is loosened under the oscillating electric field, whereas in the present invention, we believe toner is loosened by the chain flipping action of the high coercivity developer. Thus, the prior art prefers toner of high charge-to-mass. See, for example, both U.S. Pat. Nos. 4,803,518 and 4,629,669, discussed above. FIG. 14 shows that our invention, with high coercivity carrier, functions in an opposite fashion.

It is of great advantage to be able to operate at lower charge per mass, since a smaller voltage difference in the latent image is required to achieve a high density image. That is, more toner is deposited for a given voltage difference. It is also easier to find toner and carrier formulations, such as, in the selection of charge agents and polymers, that charge lower as opposed to higher. It is very difficult to find stable high charging systems. We also have observed that high charged toners can result in nonuniform transfer from photoconductor to paper, resulting in a mottled appearance.

EXAMPLE 9

FIG. 14 also shows the behavior of carriers of varied resistivity. The high coercivity, permanently magnetized carriers described in U.S. Pat. No. 4,546,060 and, as used in this invention, can be prepared over a range of specific resistivity. The carrier materials used in generating the data in Examples 1–7 display a resistivity of about $10^{11}$ ohm-cm when tested in a packed powder resistivity cell, and measured according to $$P = \frac{AV}{dI},$$

where P is the resistivity in ohm-cm, A is the area of the cell electrodes in $cm^2$, d is the electrode spacing in cm, V is the applied DC voltage and I is the measured current in amps. V is typically 50 V; d is typically 0.1 cm.

Figure 15:
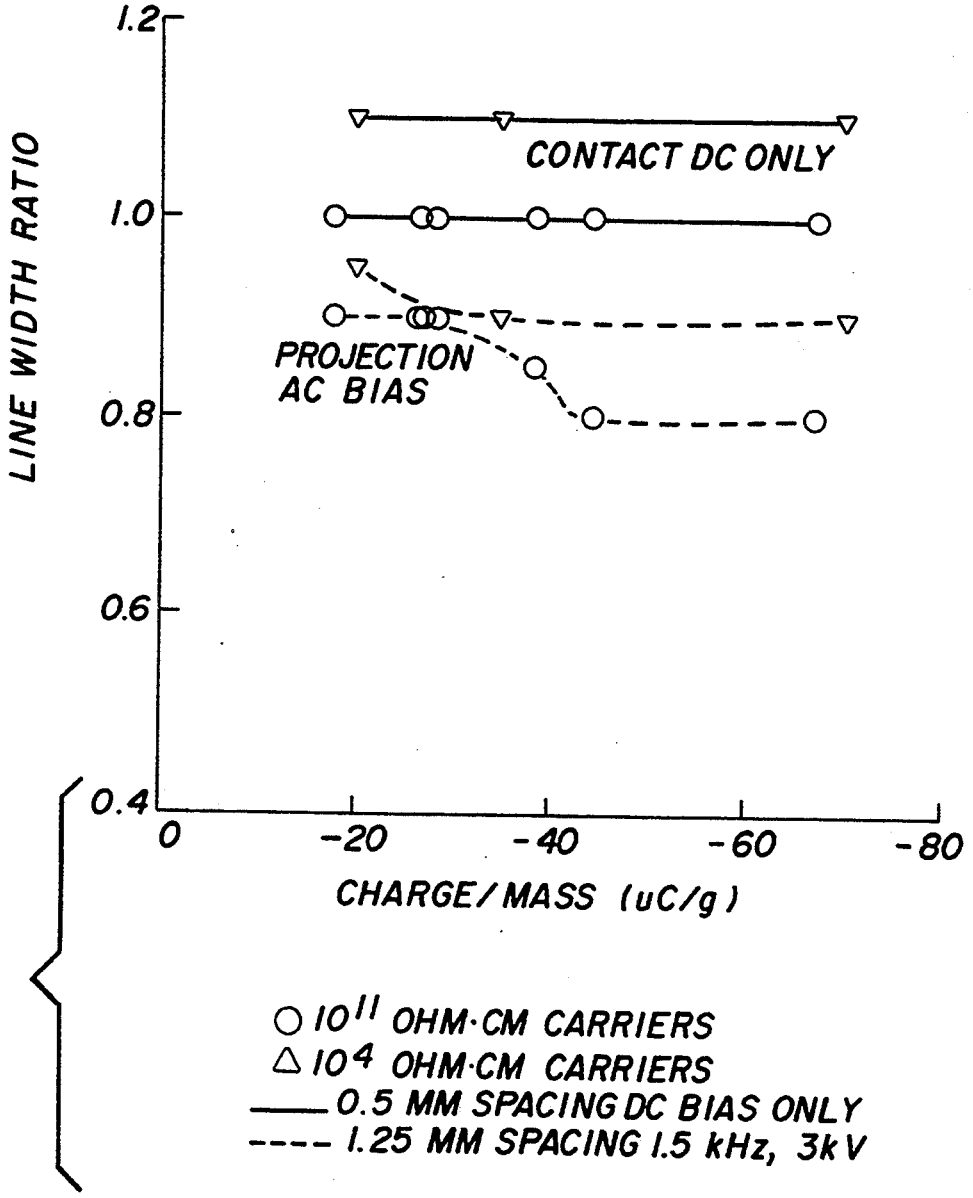

Carders of resistivity of about $10^4$ ohm-cm were prepared substantially according to U.S. Pat. No. 4,764,445, Miskinis and Saha, which patent is hereby incorporated by reference herein. These carriers were used to prepare images on the laboratory breadboard previously described (Example 1). The resulting behavior difference in terms of development completion is shown in FIG. 14. For contact DC bias-only development, the rate of development is seen to be higher for the more conductive material, while for the gap jumping development of this invention, the completion appears substantially unchanged. However, FIG. 15 shows data from these examples with line width ratio (the ratio of the width of a developed line on an image to the width of the line on the original) plotted against charge-to-mass ratio. The line width in the original in this case is 0.5 mm. The problem of narrow development of lines when projection toning is evident. It is seen that the carrier with $10^4$ ohm-cm resistivity, however, develops wider, more true lines than the carrier of $10^{11}$ ohm/cm resistivity. Thus, for most copier and printer projection toning applications using our invention, a more conductive carrier, for example, a carrier with $10^4$ ohm-cm resistivity is preferred to the $10^{11}$ ohm-cm and especially to the prior art's carrier of $10^{14}$ ohm-cm.

We believe this ability to operate advantageously with carriers of low resistivity is due to the use of permanently magnetized high coercivity carrier particles in conjunction with the rotating core magnetic brush.

EXAMPLE 10

As stated above, we believe the high development completion of the projection toning examples is due to the thick powder cloud of airborn toner formed by the vigorousness imparted to the developer by the reaction of the high coercivity carrier to rapid pole transitions. We do not believe this to be primarily due to flow rate. Experiments with varying shell or sleeve rotation bear this out.

Figure 16:
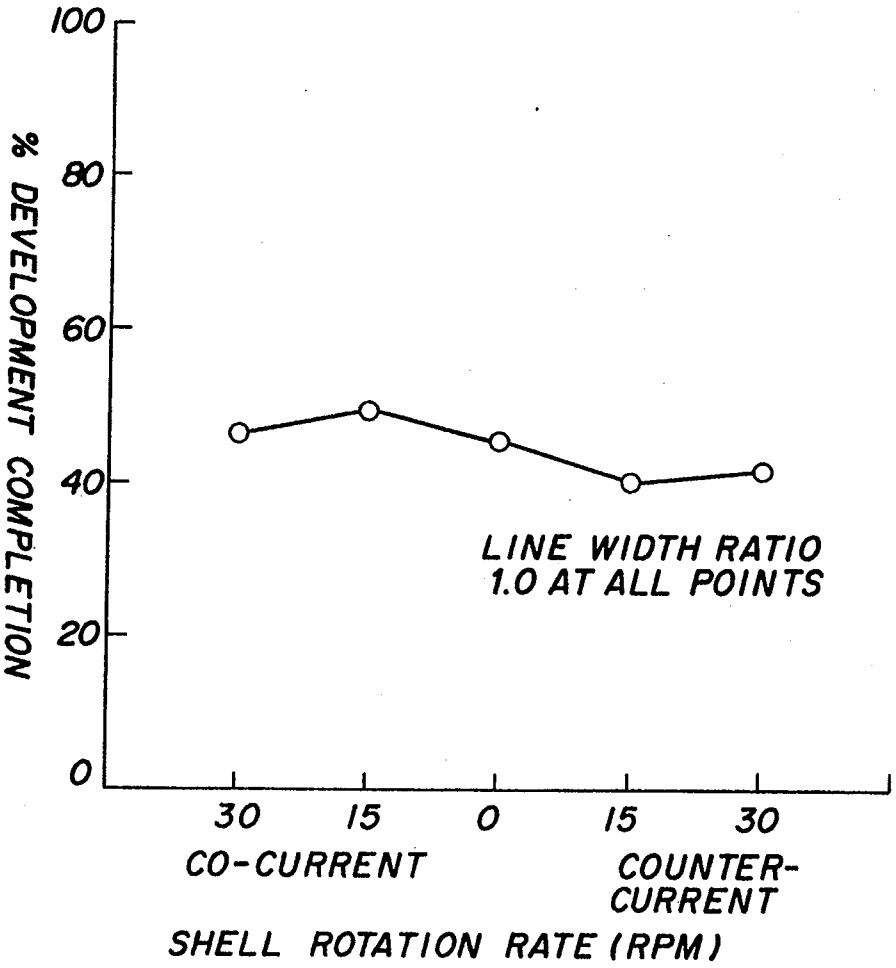
FIG. 16 is a plot of development completion against shell rotation rate.

Using the same equipment and materials as in Example 1, we varied the rotation of the sleeve or shell. FIG. 16 shows development completion plotted against shell rotation rate with a core rotation rate of 1000 rpm, a 1.25 mm spacing, an AC voltage of 3 kV and frequency of 1 kHz and a 70 volt DC offset. Crest height was less than 0.8 mm. This plot shows little development completion change as shell speed is varied. Co-current rotation of the shell is rotation with the flow of developer.

Figure 17:
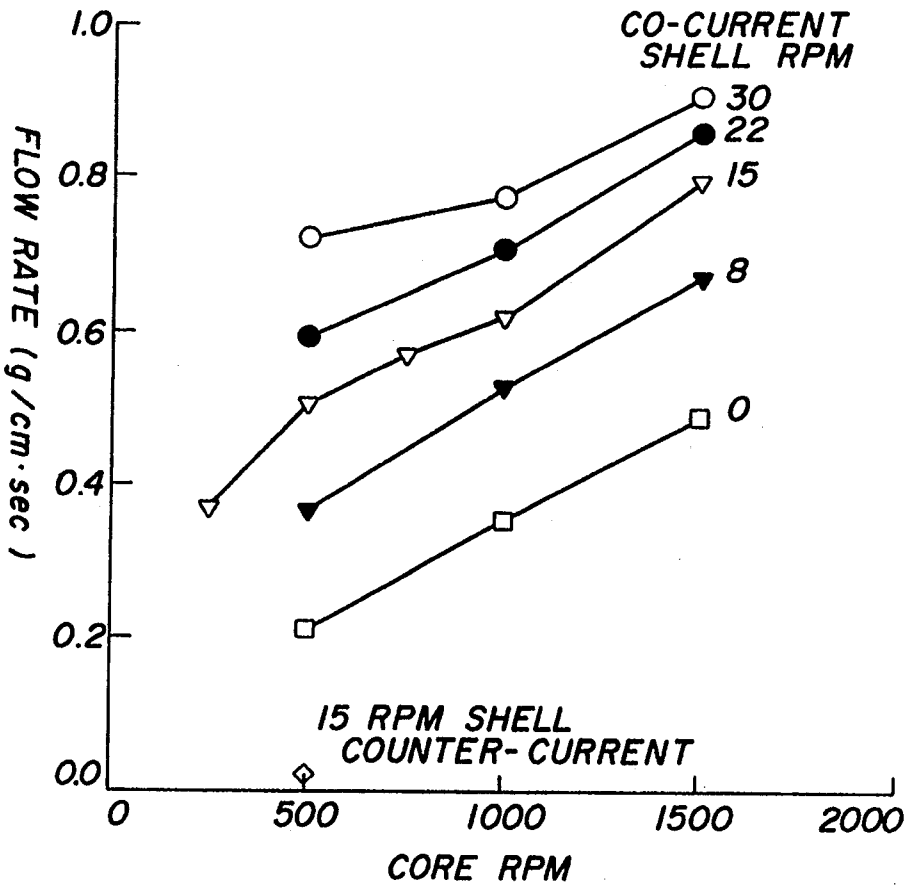
FIG. 17 is a series of plots of developer flow rate against core rotation rate for various shell rotation rates.

FIG. 17 is a plot of flow rate of a high coercivity developer against core rotation rate for various shell rotation rates. It shows that the flow rate does increase as both core and shell rotation are increased. However, FIGS. 8 and 16 show that development completion increases only in response to an increase in core rotation and not in response to shell rotation change. Thus, development completion increases (FIG. 8) are clearly due to the vigorousness of the developer movement from its high coercivity and the pole transitions and not its flow rate. This is an important aspect of the invention, since this development system provides its highest quality images when the developer is moving at the same speed as the image member. Thus, for projection toning at a given speed of image member, if the core speed is increased to increase development completion, the shell speed may be reduced (even rotated counter to developer flow) to maintain developer flow at the image member speed.

The invention has been described in detail with particular reference to a preferred embodiment thereof, but it will be understood that variations and modifications can be effected within the spirit and scope of the invention as described hereinabove and as defined in the appended claims.

What is claimed is:

1. An image forming method comprising:

forming a first dry unfixed toner image on a frame or area of an image member, without fixing said first toner image, forming an electrostatic image on the frame or area of the image member, without fixing the first toner image, applying toner to the electrostatic image to form a second toner image on the image member, said applying step including:

supplying a two component developer including high coercivity, permanently magnetized magnetic carrier particles and toner particles to an applicator having a rotatable magnetic core having alternating poles around its periphery and a shell around said core;

rotating said core within said shell to create a rapidly changing magnetic field on the surface of the shell while moving the developer either by core rotation or shell rotation or both along the shell in a wave motion having alternating crests and troughs through close proximity with an image member but without the crests of the developer contacting the image member, and applying an alternating electrical field between the shell and the image member.

2. A method of developing an electrostatic image on an image member that has an unfixed dry toner image in the same frame as the electrostatic image, said method comprising:

supplying a two component developer comprising charged toner particles and oppositely charged carrier particles, said carrier particles having a coercivity of at least 300 gauss when magnetically saturated and exhibiting an induced magnetic moment of at least 20 EMU per gram when in an applied field of 1000 gauss, to an applicator having a rotatable magnetic core having at least eight alternating poles around its periphery and a shell around the core, and rotating said core within said shell at a speed of at least 300 rpm to create a rapidly changing magnetic field on the surface of the shell while moving the developer by core rotation, shell rotation or both in a wave motion having alternating crests and troughs through close proximity with the image member but without the crests of the developer contacting the image member, and applying an alternating field of at least 500 peak-to-peak volts and a frequency of at least 300 hertz between the image member and the shell.

3. The method according to claim 2 wherein the coercivity of the carrier is at least 1000 gauss.

4. The method according to claim 2 wherein the coercivity of the carrier is at least 1500 gauss.

5. The method according to claim 2 wherein the induced magnetic moment of the carrier particles is at least 25 EMU/gm.

6. The method according to claim 4 wherein the induced magnetic moment of the carrier particles is at least 25 EMU/gm.

7. The method according to claim 4 wherein the induced magnetic moment is at least 30 EMU/gm.

8. The method according to claim 2 wherein the step of rotating the core includes rotating the core at a speed of at least 1000 rpm.

9. The method according to claim 8 wherein the step of rotating the core includes rotating the core at a speed of at least 1500 rpm.

10. The method according to claim 4 wherein the step of rotating the core includes rotating the core at a speed of at least 1500 rpm.

11. The method according to claim 10 wherein the step of rotating includes rotating a core having at least ten magnetic poles around its periphery.

12. The method according to claim 2 wherein rotating includes rotating a core having at least 12 magnetic poles around its periphery.

13. The method according to claim 12 wherein the step of rotating the core includes rotating the core at a speed of at least 1000

14. The method according to claim 2 wherein said shortest distance between the shell and the image member is at least 0.75 mm.

15. The method according to claim 2 wherein the number of poles of the core and the speed of the core are such to provide at least 200 pole transitions per second on the shell.

16. The method according to claim 15 wherein the number of pole transitions is at least 300 per second.

17. The method according to claim 2 wherein the image member and the developer are moved in the same direction at substantially the same speed.

* * * * *